US010844598B2

(12) United States Patent
Chitsaz et al.

(10) Patent No.: US 10,844,598 B2
(45) **Date of Patent: *Nov. 24, 2020**

(54) TRANSLUCENT CEILING OR WALL PANEL

(71) Applicant: CertainTeed Canada, Inc., Toronto (CA)

(72) Inventors: Ali Chitsaz, Toronto (CA); Martin Gerkes, Toronto (CA)

(73) Assignee: CertainTeed Canada, Inc., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/687,894

(22) Filed: Nov. 19, 2019

(65) Prior Publication Data

US 2020/0190796 A1 Jun. 18, 2020

Related U.S. Application Data

(63) Continuation of application No. 16/031,447, filed on Jul. 10, 2018, now Pat. No. 10,480,187, which is a (Continued)

(30) Foreign Application Priority Data

Apr. 14, 2016 (CA) ..... 2927168

(51) Int. Cl.

| | |
|---|---|
| ***E04F 13/00*** | (2006.01) |
| ***E04B 9/04*** | (2006.01) |
| ***E04F 13/08*** | (2006.01) |
| ***E04B 9/26*** | (2006.01) |
| ***E04B 9/00*** | (2006.01) |

(Continued)

(52) U.S. Cl.

CPC ..... *E04B 9/0428* (2013.01); *E04B 9/003* (2013.01); *E04B 9/0435* (2013.01); *E04B 9/064* (2013.01); *E04B 9/225* (2013.01); *E04B 9/26* (2013.01); *E04B 9/28* (2013.01); *E04B 9/32* (2013.01); *E04F 13/005* (2013.01);

(Continued)

(58) Field of Classification Search

CPC ..... E04B 9/0428; E04B 9/064; E04B 9/28; E04B 9/225; E04B 9/0435; E04B 9/32; E04F 13/072; E04F 13/09; E04F 13/005; E04F 13/078; E04F 13/0862

See application file for complete search history.

(56) References Cited

U.S. PATENT DOCUMENTS

| | | | |
|---|---|---|---|
| 2,186,129 | A | 6/1965 | Blood |
| 3,460,299 | A | 8/1969 | Wilson |

(Continued)

FOREIGN PATENT DOCUMENTS

DE 202014104186 U1 9/2015

*Primary Examiner* — Patrick J Maestri

(74) *Attorney, Agent, or Firm* — McDonnell Boehnen Hulbert & Berghoff LLP

(57) ABSTRACT

A ceiling panel according to the present invention has opposed translucent membranes secured in a tensioned state across a perimeter frame. The frame includes frame members that are designed to oppose inward bowing of the perimeter frame caused by the tensioned membranes. The frame members have a side profile shaped to conceal a grid support network with the lower translucent member extending across and about a lower edge of the perimeter frame. The invention also includes a modified structure for supporting of translucent panels below a grid network.

20 Claims, 10 Drawing Sheets

Related U.S. Application Data continuation of application No. 15/483,532, filed on Apr. 10, 2017, now Pat. No. 10,030,385.

(51) Int. Cl.

| | |
|---|---|
| ***E04B 9/06*** | (2006.01) |
| ***E04B 9/22*** | (2006.01) |
| ***E04B 9/28*** | (2006.01) |
| ***E04B 9/32*** | (2006.01) |
| ***E04F 13/072*** | (2006.01) |
| ***E04F 13/09*** | (2006.01) |

(52) U.S. Cl.

CPC ..... *E04F 13/072* (2013.01); *E04F 13/0864* (2013.01); *E04F 13/09* (2013.01); *E04B 2009/0492* (2013.01)

(56) References Cited

U.S. PATENT DOCUMENTS

| | | | | |
|---|---|---|---|---|
| 7,685,786 | B2 | 3/2010 | Cousin | |
| 8,910,748 | B2 | 12/2014 | Nielsen | |
| 10,030,385 | B2 | 7/2018 | Chitsaz | |
| 10,480,187 | B2 | 11/2019 | Chitsaz | |
| 2011/0203210 | A1* | 8/2011 | Cousin | E04B 9/0428 52/506.06 |
| 2013/0264145 | A1* | 10/2013 | Nielsen | E04B 1/8209 181/284 |
| 2017/0016234 | A1 | 1/2017 | Scherrer | |

* cited by examiner

TRANSLUCENT CEILING OR WALL PANEL

This application is a continuation of U.S. patent application Ser. No. 16/031,447, filed Jul. 10, 2018, which is a continuation of U.S. patent application Ser. No. 15/483,532, filed Apr. 10, 2017, which claims the benefit of priority of Canadian patent application no. 2927168, filed Apr. 14, 2016, each of which is hereby incorporated herein by reference in its entirety.

FIELD OF THE INVENTION

The present invention relates to translucent wall or ceiling panels and in particular to improvements to a perimeter frame of a panel and a system where the panel cooperates with a supporting grid network in a particular manner.

BACKGROUND OF THE INVENTION

Translucent wall or ceiling panels are known and in most cases these translucent wall or ceiling panels include a top translucent membrane in opposed relationship to a finished translucent wall membrane. These panels include an outer perimeter frame used to support each panel individually to one side of a support grid network or in some cases the panels are directly connected with each other and supported at the periphery of the connected panels. Natural light or a powered light source to the top side of the ceiling panels can transmit light through the panels and provide light to the underside of the panels.

An issue associated with translucent wall or ceiling panels is that the membranes are tensioned across a perimeter frame and the size of the translucent wall or ceiling panels must be restricted to avoid frame bending or there must be a mechanism to oppose inwards bowing of the perimeter frame caused by the tension force of the translucent wall membranes.

One solution for inward bowing of ceiling panels which allows the ceilings panels to be of a considerable size is shown in U.S. Pat. No. 9,091,054 where a mechanical bolt arrangement is used to secure the ceiling panels to each other and effectively draw opposed perimeter frames into abutment. This system uses a perimeter frame which is not strong enough to avoid inward bowing of the frame caused by the tension exerted on the frame by the translucent membranes. To remedy the deflection of the perimeter frames, the perimeter frames engage each other using a bolt securement to bring the panels back to a square configuration.

A further design feature of translucent wall or ceiling panels is to provide sufficient light transmission to the lower edge of the panel adjacent the perimeter frame. In most cases it is desirable to provide the visual effect that the entire panel is effectively lit and any structure of the frame that extends into the interior of the panel should not be obviously apparent from the lower surface of the panel.

The present invention discloses a ceiling or wall panel which inherently limits the amount of inward bowing caused by the tensioned translucent membranes and provides a simple arrangement for correcting any inward bowing as well as allowing the panel to be secured below a ceiling grid system or to one side of a wall grid system. This structure can be used with a concealed ceiling grid, where the ceiling grid is above the lower surface of the ceiling panels and is hidden by the panels when the panels are placed in an in use position.

SUMMARY OF THE INVENTION

A ceiling or wall panel for securement to one side of a grid support network, according to the present invention, comprises a perimeter frame with a finished faced translucent membrane and an opposed translucent membrane. With said membrane secured across the perimeter frame in a tension state either side of the perimeter frame. The perimeter frame includes connected frame members, which each frame members having on an outside face thereof a stepped profile extending between secured membranes. Each frame member includes an outwardly stepped edge having the finished face membrane wrapped thereover with the opposed membrane secured across the perimeter frame and wrapped about a securing edge of the perimeter frame at a position inwardly of the outwardly stepped edge. Each frame member includes an inwardly projecting stiffening member joining said outward stepped edge and the securing edge and shaped to oppose inward bowing of the frame member caused by the tension state of the membranes across the perimeter frame.

According to an aspect of the invention, the frame member in cross section includes a first diagonal arm extending from the securing edge, a second diagonal arm extending from the outwardly stepped edge and the diagonal arms are joined adjacent a mid-portion between the membranes.

According to a further aspect of the invention, the diagonal arms are joined by a curved segment.

In yet a further aspect of the invention, the second diagonal arm extends at an angle between 30 and 60 degrees relative to the finished face member.

In yet a further aspect of the invention, the second diagonal arm is longer than the first diagonal arm and the diagonal arms are connected by a curved segment with a mid-portion of the curved segment located closer to the opposed membrane.

In yet a further aspect of the invention, the ceiling panel is of a rectangular shape with each side of the rectangular shape being less than 6 feet.

In yet a further aspect of the invention, the connected frame members are of an extruded aluminum or aluminum alloy material. Each outwardly stepped edge is less than one inch in width and is of a triangular shape with a lower edge of the triangular shape including a membrane wrap edge with a membrane securing cavity above said wrap edge and inwardly located relative to an outside edge of the panel. The triangular shape forms a lower portion of the stiffening member.

According to an aspect of the invention, the triangular shape merges with a mid-portion of the stiffening member, and the mid-portion in cross section including a lower triangular portion and an upper box portion which are aligned at an outside edge of the panel to form an inward wall of the stepped portion. The upper box portion including interior thereto securing slots having a stiffening member received therein and adapted to form part of a mechanical securement of one frame to an adjacent frame member to form a corner inaction of the ceiling panel.

In yet a further aspect of the invention, the mid-portion on an outside face of the panel includes securing slots extending inwardly from the stepped edge.

In a further aspect of the invention, each frame member above the upper box portion includes a top triangular hollow portion with an outside wall forming part of the stepped edge and including in the stepped edge portion, a membrane securing slot securing the opposed membrane across the perimeter frame.

In yet a further aspect of the invention, the top triangular hollow portion and the mid-portion have a curved surface that is part of a downwardly angled wall of the top triangular hollow portion and a curved wall of the mid-portion that joins with an upwardly angled wall of said stepped edge.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
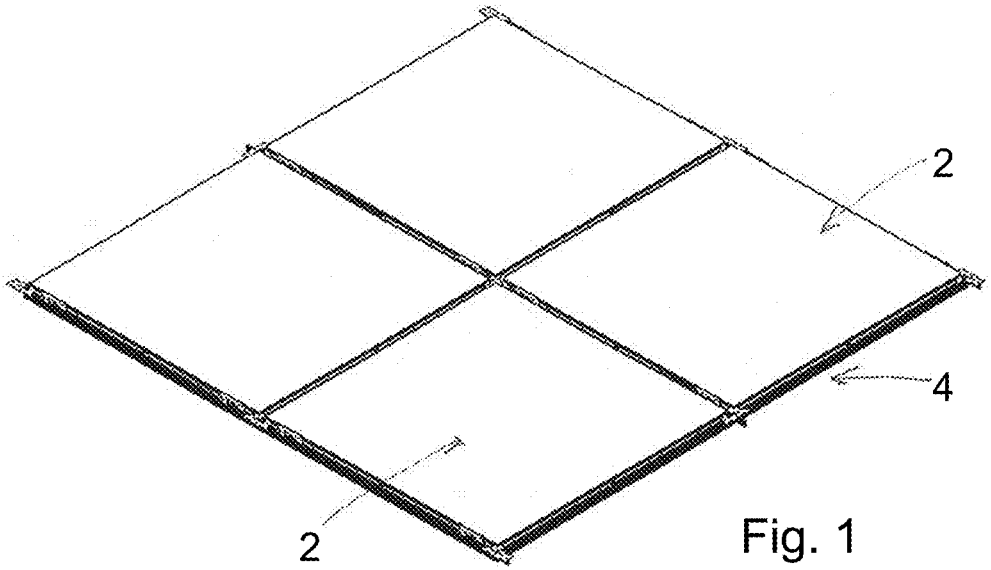
FIG. 1 is a perspective view of four translucent ceiling panels supported below a grid support system.
Figure 2:
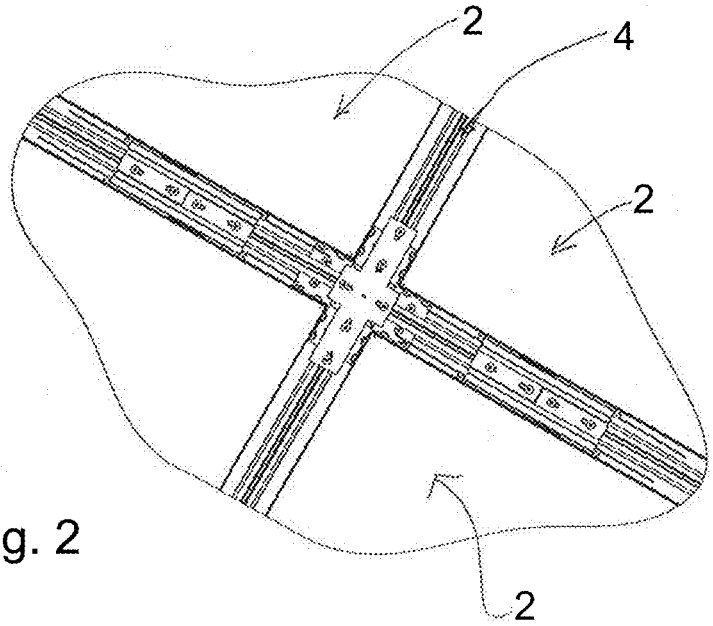
FIG. 2 is a top view looking downwardly on a junction of the grid support network showing the corners of four supported translucent ceiling panels.

Four translucent wall or ceiling panels 2 are shown in FIG. 1 supported by a grid support network 4. Basically the grid support network 4 defines cells and each ceiling panel is received in a cell. The translucent wall or ceiling panels 2 preferably cooperate with the grid support network to conceal the grid support network above the finished surface of the ceiling. The ceiling panels have a stepped profile to allow for this concealment and the panels are preferably suspended beneath the gird support network or to one side of the grid support network by means of torsion springs 6 as shown in FIGS. 3 and 4.

The grid support network 4 can also support non-translucent panels and the structure of this grid network is disclosed in our earlier U.S. Pat. No. 8,474,200. There are certain modifications of the grid system to support translucent panels and these modifications of the grid support network will be described in combination with the structure of the translucent panels.

In use, the area above the translucent panels can either be provided with artificial light for allowing light to be transmitted through the translucent panels or there may be a natural light source behind the panels that allows light to be transmitted through the panels. The translucent wall or ceiling panels typically have translucent membranes on opposite sides thereof with the top membrane separating any dust or material which may collect on the upper membrane from effectively being visible through the lower finished membrane. Double membranes also allow the panels to be removed and the user can conveniently clean the upper membrane of any accumulated material or dust.

Figure 3:
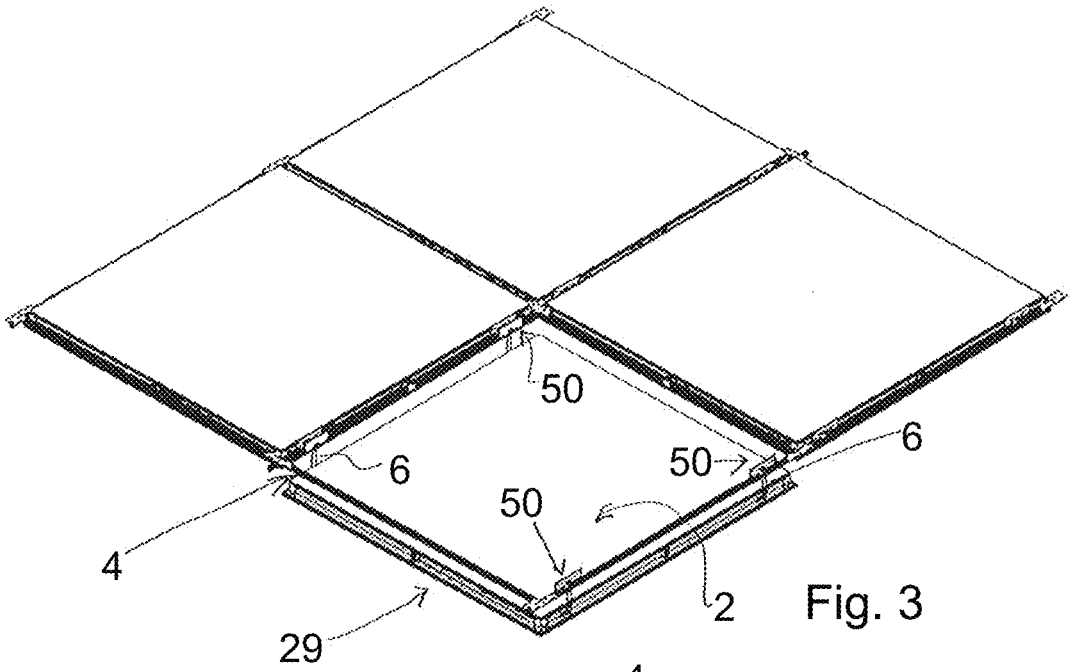
FIG. 3 is a perspective view similar to FIG. 1, with one of the translucent ceiling panels partially disengaged and suspended below the grid support network prior to being moved to a finished position.
Figure 4:
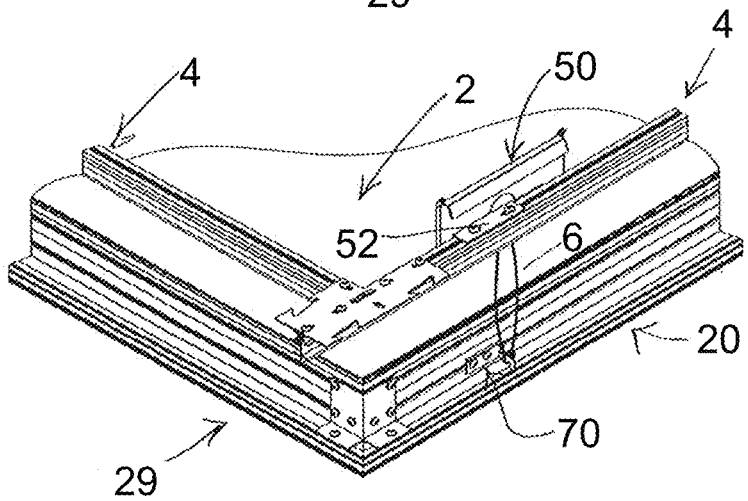
FIG. 4 is a partial perspective view of a translucent ceiling panel suspended downwardly of a cornered junction of a grid support network.

In FIG. 3 it can be seen that translucent ceiling panel 2*a* is spaced downwardly from the grid support network 4 and hangs below the grid support network by torsion springs 6. These torsion springs engage butterfly clips 50 that are secured to the grid support network. Each butterfly clip 50 includes a top flange 52 that is secured to an upper securing slot 260 of the grid support network. The butterfly clip 50 is of a narrow width and uses the vertical space immediately adjacent the grid support network 4 to allow for securement of the ceiling panel. The frame member 20 of the ceiling panel 2*a* includes a torsion spring securing bracket 70 mechanically secured to a securing slot of the frame member 20 that engages and retains a coil of the torsion spring 6.

Figure 5:
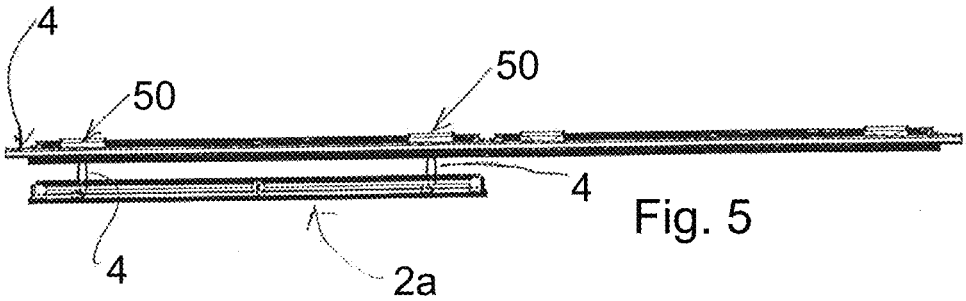
FIG. 5 is a side view of the perspective view of FIG. 3.

Once the translucent panel 2*a* has been secured beneath the gird network as shown in FIG. 5, it can then be pushed upwardly to engage the grid member and be supported beneath the grid member. The butterfly clip 50 and the torsion spring 6 having cured arms has been specifically designed for securing of the translucent wall panels.

Figure 6:
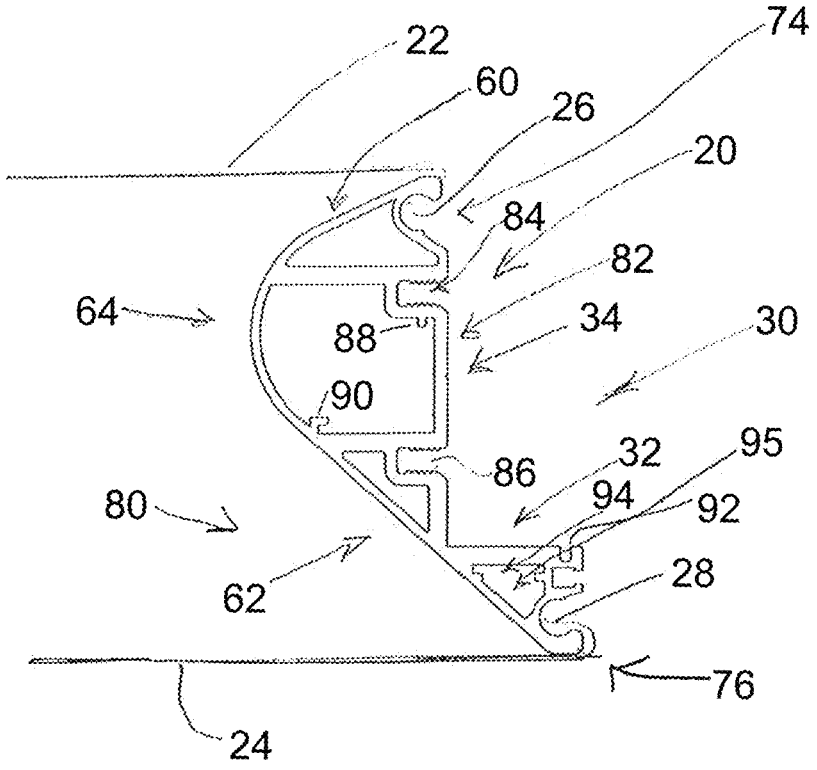
FIG. 6 is a cross section through a translucent ceiling panel showing the frame member, the membranes of the panel and various cavities of the frame member.

FIG. 6 shows details of the frame member 20 which is made by extrusion to include a series of stiffening cavities and securing slots for strengthening of the frame member particularly with respect to bowing of the frame member that can occur when the finished face translucent membrane 24 and the opposed translucent membrane 22 are secured in a tensioned state across connected frame members. It can be seen from the cross section illustrated in FIG. 6 that the frame member 20 on the outside edge thereof, includes a stepped profile 30 having a step 32 and a vertical face 34 to generally form an 'L' shaped recess. Below this shaped recess, the finished face translucent membrane 24 is secured in the securing cavity 28 by means of a spline member (not shown). The interior surfaces of the frame member 20 include a first diagonal arm 60 and a second diagonal arm 62 with these arms connected by the curved segment 64. The first diagonal arm 60 is significantly shorter (preferably 40 to 60% shorter) than the second diagonal arm 62 and extends downwardly from the securing edge 74 to the curved segment 64. The second diagonal arm 62 extends upwardly at an angle in the range of 30 to 60 degrees to accommodate a substantial cavity 80, that is, to the lower side of the second diagonal arm 62. This large cavity 80 adds strength but still allows light that is striking the upper surface of the panel to partially fill below the second diagonal arm 62. With this arrangement it is found that the frame member is not noticeably visible through the finished face translucent membrane 24.

The curved segment 64 includes substantial structure to the outside of the ceiling panel which is of a box like configuration generally shown as 82. The box like configuration 82 acts as a stiffening member and also helps to define the securing slots 84 and 86 to opposite sides of the box like cavity. It can also be seen that the box like cavity 82 includes two guide tabs 88 and 90 that receive a securing bracket helpful in securing two framing members to one another at a corner junction.

The frame member 20 also includes a lower cavity 92 having a guide channel generally shown as 94 that receives a further bracket as part of a securing arrangement of a frame member to frame member connection. This lower cavity 92 serves to stiffen the frame member adjacent the securing cavity 28 used to secure the translucent membrane 24. Preferably the frame member 20 is made of an extruded aluminum or aluminum alloy and although designed to oppose bending of the frame member, the frame member remains relatively light weight.

Figure 7:
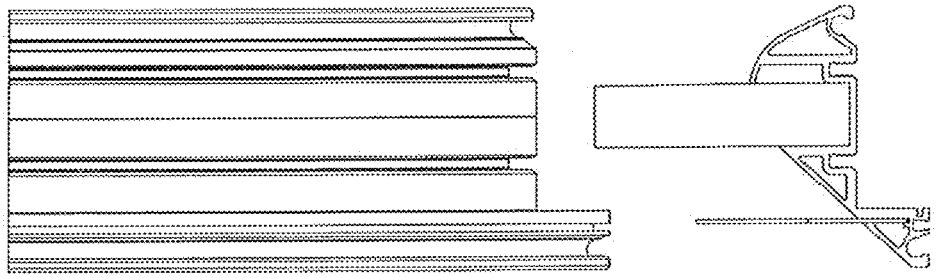
FIG. 7 is a side view showing one frame member about to be secured to an adjacent frame member.
Figure 8:
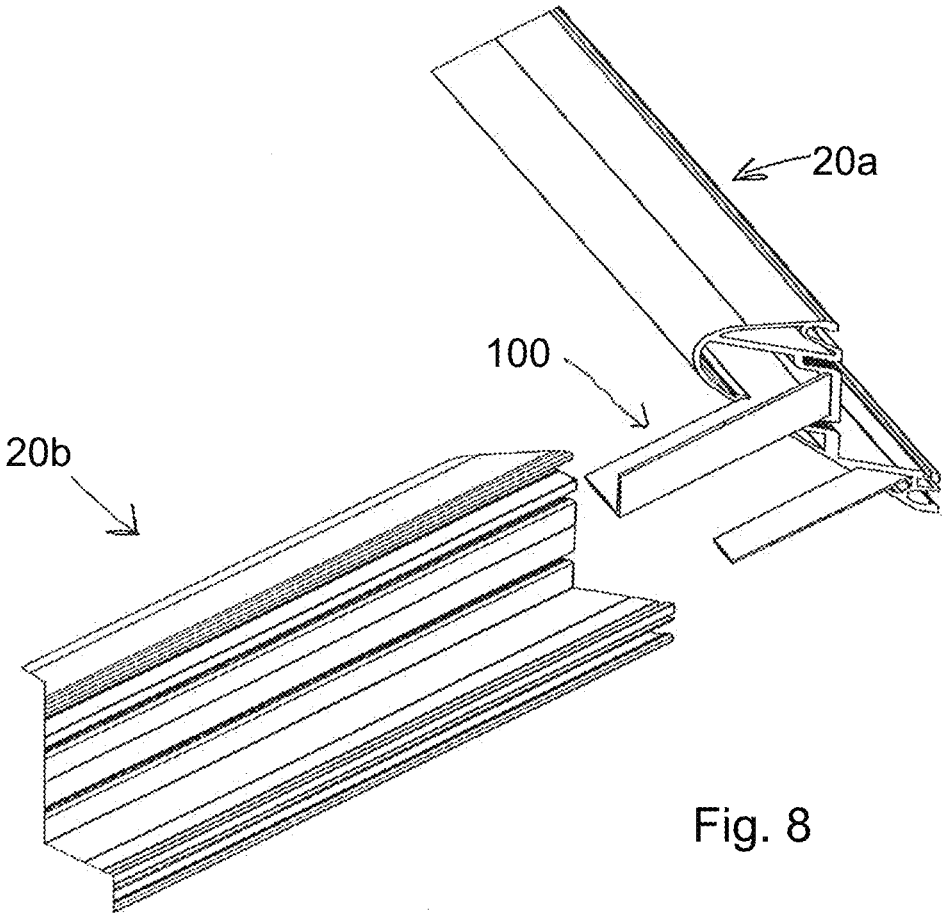
FIG. 8 is a partial perspective view showing the securement illustrated in FIG. 7.
Figure 9:
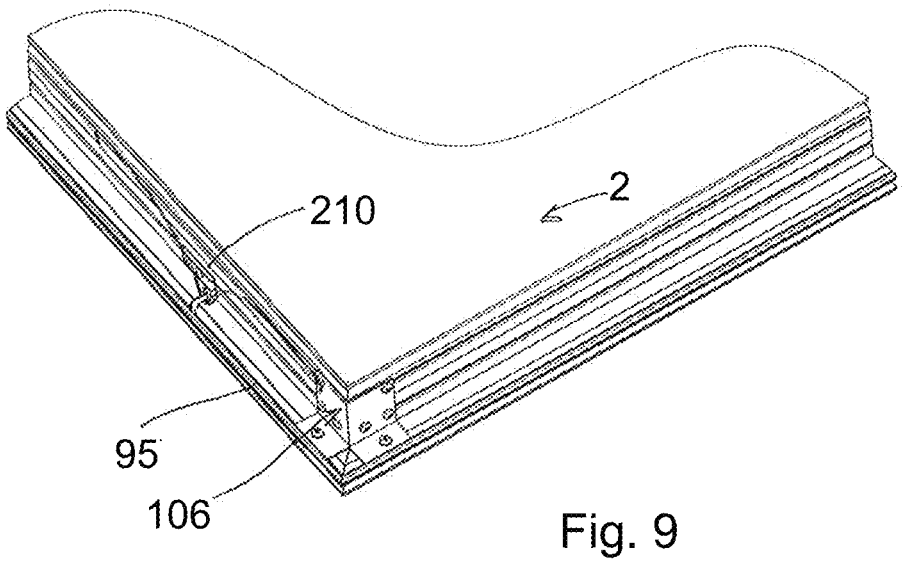
FIG. 9 is a partial perspective view showing the two frame members of FIG. 8 being secured by additional corner brackets.

Details of a frame member to frame member connection can be appreciated from a review of FIGS. 7 and 8. The frame member 20*a* is about to be secured to frame member 20*b* in a perpendicular connection. Each of the frame members 20*a* and 20*b* have a diagonal miter cut to form the corner connection. A double shaped L bracket 100 has been secured in the box like configuration 82. This double L bracket 100 is received interior to the box like configuration and is held in slide engagement therewith due to the guide tabs 88 and 90. A flat L shaped bracket 102 is received in the slot 94 of the lower cavity 92. In this way the double L shaped bracket and the single L bracket 102 form an interior mechanical connection of the frame members 20*a* and 20*b*. Once the frame members are brought into abutment as shown in FIG. 9, a further corner bracket 106 can reinforce the outer corner. The outer corner bracket 106 has a series of screw fasteners that will engage securing slots in through the frame members 20*a* and 20*b*. This corner securement captures the double L bracket 100 on the interior of the panel and further reinforces the corner connection. This arrangement simplifies initial alignment of frame members and strengthens the corner connection.

Figure 10:
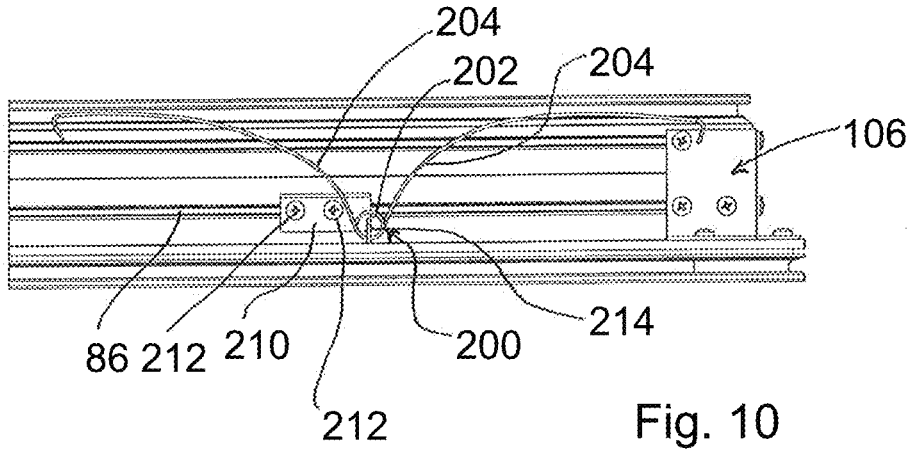
FIG. 10 is a side view showing the portion string (?) securement used in FIG. 9.

A finished corner connection is shown in FIGS. 9 and 10 and the one piece corner bracket 106 on each face of the corner includes three screws in the vertical face that engage channels 84 and 86 in the frame member and one screw that passes through the horizontal step 32. FIG. 9 also shows the curved torsion spring 200 secured to a vertical face of the ceiling panel 2 by the torsion spring bracket 210. A torsion spring bracket 210 is secured to a securing cavity 86 by the screw fasteners 12. The securing bracket 210 includes an L shaped arm 214 that captures the coil 202 of the torsion spring. The free end of the L shaped arm 214 engages a securing slot 95 in the step 32 and thus the curved torsion spring is captured on the L shaped arm. The arms 204 of the torsion spring are curved rather than straight and this curve effectively utilizes space alongside the panel as opposed to above the panel to accommodate the spring when it is moved to the final finished position of the ceiling panel. This arrangement is helpful in ceilings having restricted space above the ceilings and also maintains the torsion springs generally within the thickness of the ceiling system (see FIG. 21).

Figure 15:
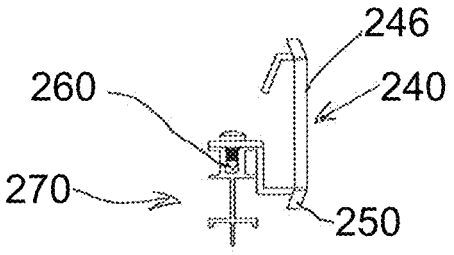
FIG. 15 is an end view showing the attachment of a butterfly clip to the grid support network.
Figure 16:
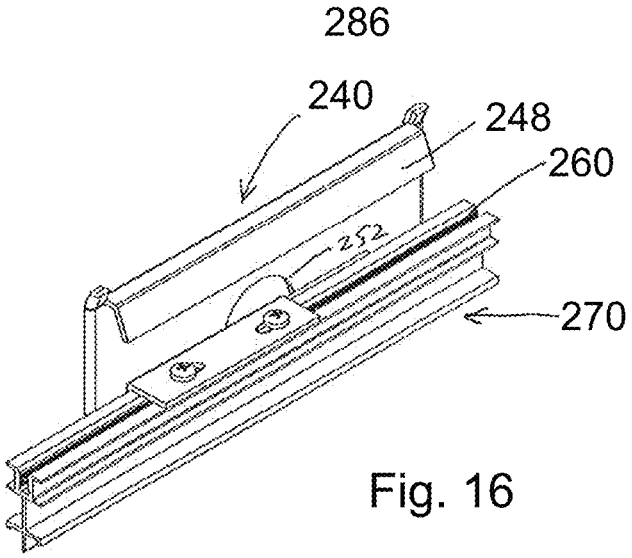
FIG. 16 is a partial perspective view showing the butterfly clip and grid member from FIG. 15.
Figure 17:
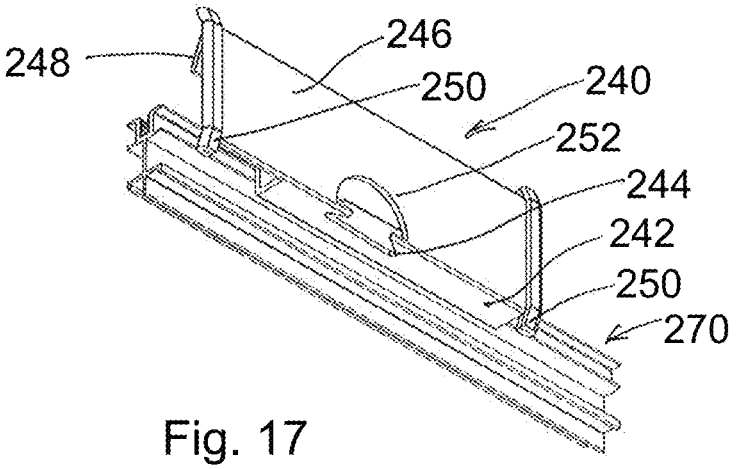
FIG. 17 is a bottom perspective view from the opposite side showing the butterfly clip.
Figure 18:
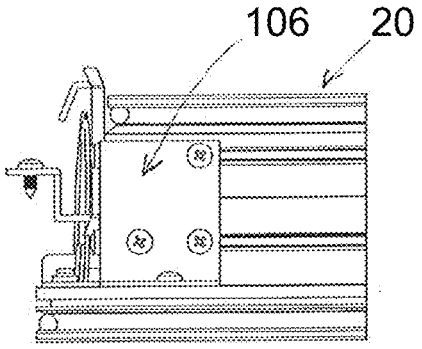
FIG. 18 is an illustration of the stepped profile of the translucent panel showing a corner bracket as well as the butterfly securing bracket relative to the position of the grid network.
Figure 19:
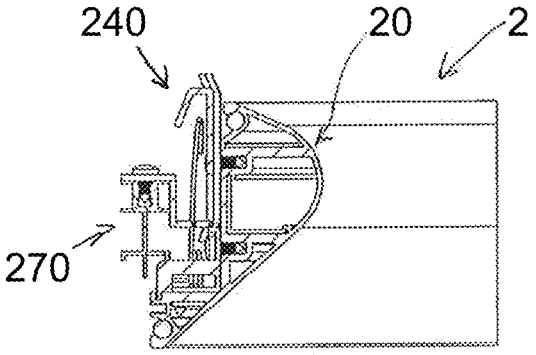
FIG. 19 is a section through the grid network and a translucent ceiling wall panel showing the frame member in its cooperation with the grid network.
Figure 20:
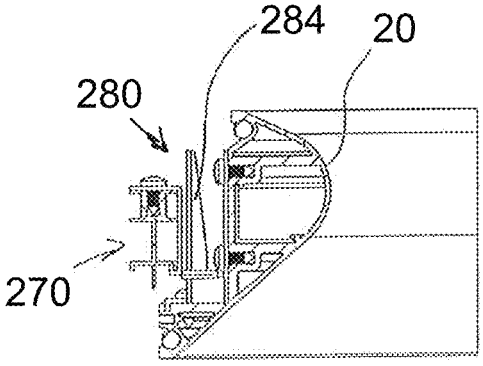
FIG. 20 is a cross section through the grid and ceiling panel illustrating the cooperation of the kicker member and the keeper loop used to align a panel with the grid network.

The curved torsion spring cooperates with a vertically extending butterfly bracket 240 secured to a top surface of the grid support network 2 in a receiving slot 260. The grid network includes individual grid members 270 as shown in FIGS. 15, 16, and 17. The butterfly bracket 240 as shown in FIG. 17, includes a lower surface 242 that is positioned downwardly from the top edge of the grid member 270 and to one side of the grid member. This lower surface includes a torsion spring securing slot 244 that will receive and engage the curved arms 204 of the torsion spring. It can be appreciated that the arms of the torsion spring pass through the securing slot 244 with the curved arms positioned between the grid member 270 and a separating vertical plate 246 of the butterfly bracket 240. This arraignment allows the arms of the torsion spring to be controlled and positioned in the vertical plane alongside the grid member. It can also be seen that the butterfly bracket 240 includes a downwardly extending top lip 248 which also serves to restrict the arms 204 of the torsion spring.

With translucent ceiling or wall panels, it is desirable to keep the space above the upper translucent membrane effectively clear of securing structures. In this way the structures will not create shadows which may be visible through the lower finished translucent member. The butterfly clip also includes downwardly extending standoff legs 250 which can act as a controlled surface determining the exact position of the translucent panel below the grid member. The actual engagement of the arms of the torsion springs far suspension of the translucent panels to one side of the grid member is accomplished by the cooperation of the torsion springs and the securing slot 244. Preferably the butterfly clip 240 also includes a cutaway portion 252 to simplify the securement of the torsion arms in the securing slot 244. The butterfly clips 240 are typically provided adjacent a node of the grid network and spaced somewhat from the corner. As can be appreciated any bowing of the frame members 30 will occur at a mid-position as the corners of the panels cooperate with each other and prevent bowing. The panels are made in a jig used to maintain the desired shape of the perimeter frame during initial securement of the membranes.

Figure 11:
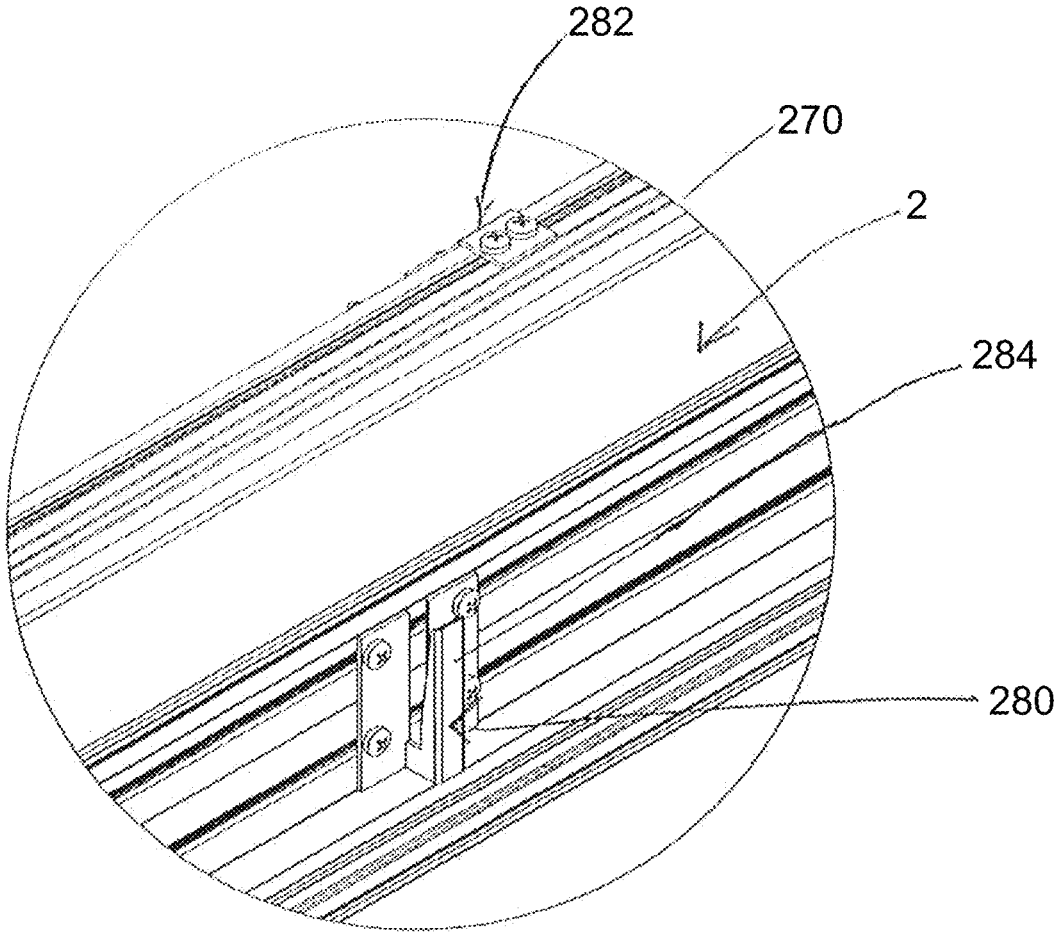
FIG. 11 is a partial perspective view of a translucent ceiling wall panel about to be moved upwardly and engaged with a grid support member having a securing loop attached thereto.

It has been found that the translucent ceiling or wall panels where the sides of the panel have a length less than 6 feet that the frame members 30 can resist substantial bowing, although some bowing will occur at the midpoint in the length of the frame member. To overcome this tendency one or more kicker brackets 280 are secured to the side of the ceiling panel 2 as shown in FIG. 11. A loop bracket 282 is secured to the grid member 270 and will receive the tapered finger 284 of the kicker bracket. The loop bracket 282 is better shown in FIGS. 12 and 13 and the bracket includes an outwardly extending flange 286 having a receiving port 288. The tapered finger 284 of the kicker bracket is initially loosely received in the receiving cavity 288 of loop bracket and with further movement of the panel upwardly towards the grid member 270, the tapered figure will bring the ceiling panel into alignment with the grid at the midpoint. This arrangement has been found to provide good alignment of panels and there is no visibly apparent curve in the panels. It is possible to use more than one kicker bracket and brackets along the length of the panels, however in a 5 foot panel with the frame member 30 as shown in FIG. 6, one such combination per frame member is sufficient. In some ceiling or wall applications the translucent panels are used in combination with non-translucent ceilings panels. In such combination systems it is possible to provide additional bracing to the grid system about cavities or a large area that will receive translucent panels. This can strengthen the perimeter frame to avoid deflection of the grid system.

Figure 12:
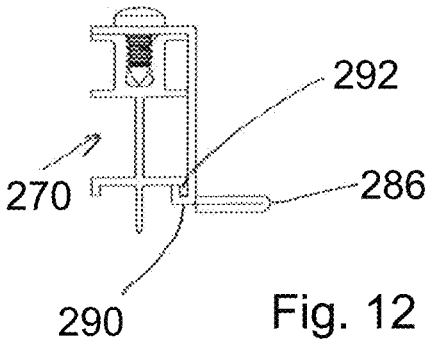
FIG. 12 is a sectional view through the grid member showing the attachment of the keeper loop.
Figure 13:
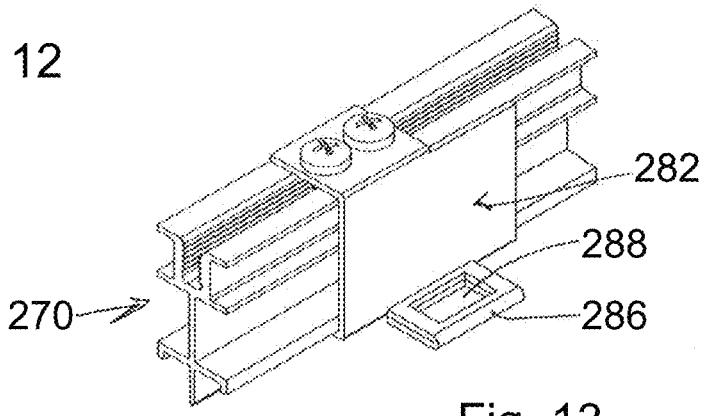
FIG. 13 is a partial perspective view showing the keeper loop in FIG. 12.
Figure 14:
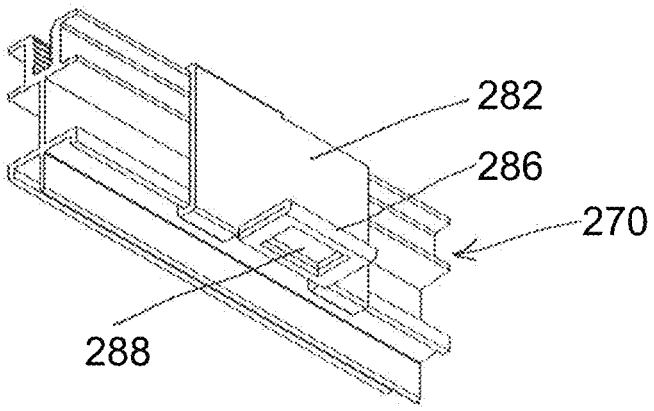
FIG. 14 is a partial perspective view showing additional details of the keeper loop in FIG. 13.

As shown in FIG. 12, the loop bracket 282 includes an upwardly extending tab 290 that engages a downwardly extending tab 292 of the grid member. In this way the top securement of the loop bracket to the grid member maintains the loop bracket in a parallel relationship with the grid member.

FIG. 4 shows the typical location of the butterfly brackets as well as the kicker brackets on a ceiling or wall panel 2.

Figure 21:
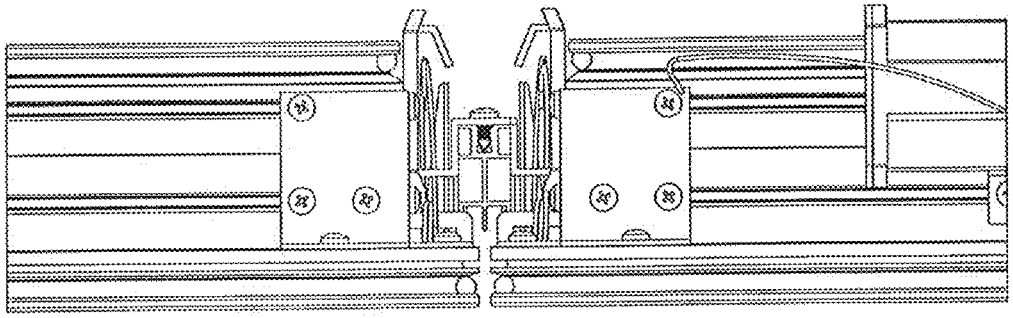
FIG. 21 illustrated two translucent ceiling panels secured either side of the grid network.
Figure 22:
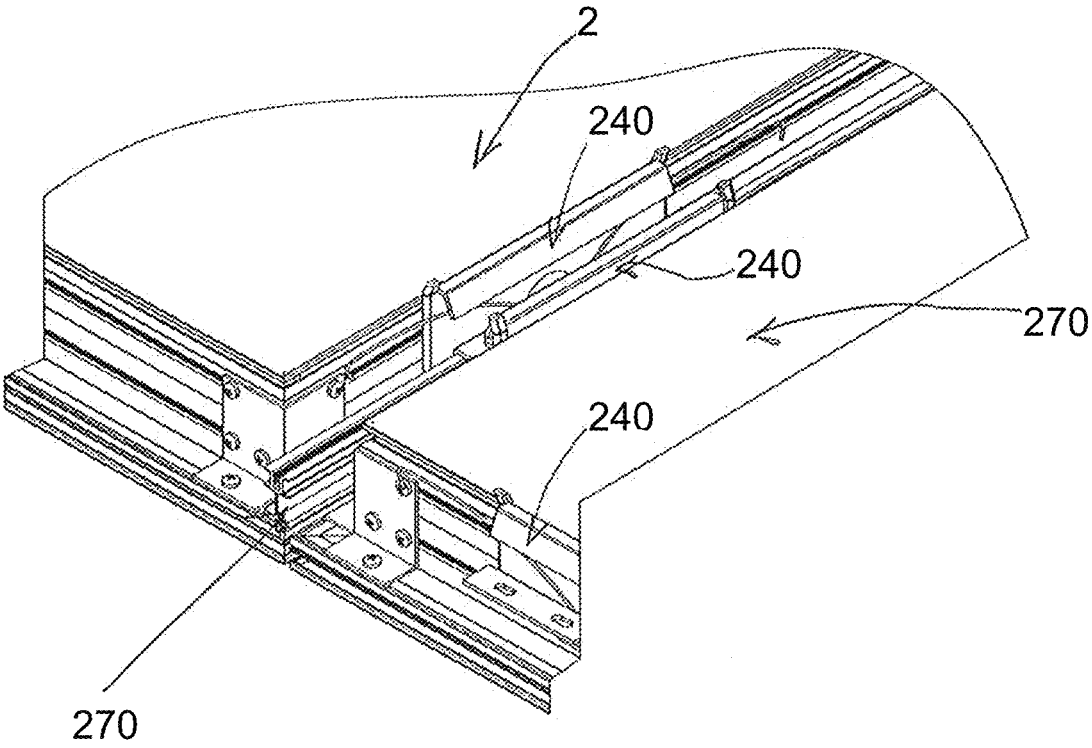
FIG. 22 is a partial perspective view of the two panels and grid network shown in FIG. 21.

FIGS. 21 and 22 show additional details of the cooperation between the grid member and the various securing arrangements where two translucent panels 2 are in a finished position below a grid member 270.

The scope of the claims should not be limited by the preferred embodiments set forth in the examples, but should be given the broadest interpretation consistent with the description as a whole.

The embodiments of the invention in which an exclusive property or privilege is claimed are defined as follows:

1. A frame strip for a ceiling or wall panel, the frame strip being linearly-extending and having an outside face and an interior face opposing the outside face, and a top end and a bottom end opposing the top end, the frame strip having a cross-sectional profile comprising:

a securing edge disposed at the outside face at the top end, an outwardly-stepped edge disposed at the outside face and stepped outwards of the securing edge at the bottom end, an inwardly-projecting stiffening member shaped to oppose inward bowing of the frame member caused by tension across the perimeter frame, the inwardly-projecting stiffening member being disposed at the interior face and joining the outwardly stepped edge and the securing edge, the stiffening member including:

a first diagonal arm extending from a first location between the top end and the bottom end, upwards and inwards from the outwardly stepped edge, a second diagonal arm extending from a second location between the top end and the bottom end, downwards and inwards from the securing edge, the first diagonal arm and the second diagonal arm being joined to one another at the first and second locations thereof.

2. The frame strip according to claim 1, wherein the second diagonal arm is longer than the first diagonal arm.

3. The frame strip according to claim 1, wherein the frame strip is less than 6 feet in length.

4. The frame strip according to claim 1, wherein the outside edge includes a vertical face that forms an L-shaped recess together with the outwardly-stepped edge.

5. The frame strip according to claim 1, having a first end at one end of the linearly-extending strip, and a second end at another end of the linearly-extending strip, wherein each of the first end and the second end has a diagonal miter cut so as to form a corner connection with another frame strip.

6. The frame strip according to claim 1, wherein the first diagonal arm and the second diagonal arm are joined by a curved segment disposed at the interior edge and joining the first diagonal arm and the second diagonal arm at the first and second locations thereof.

7. The frame strip according to claim 1, wherein the securing edge has formed therein a membrane-securing cavity for the insertion of a membrane and a spline, and wherein the outwardly-stepped edge has formed therein a membrane-securing cavity for the insertion of a membrane and a spline.

8. The frame strip according to claim 1, wherein each outwardly stepped edge is less than one inch in width and is of a triangular shape, wherein the triangular shape forms a lower edge portion of the stiffening member.

9. The frame strip according to claim 8, wherein the triangular shape merges with a mid-portion of the stiffening member, wherein the mid-portion of the stiffening member includes, in cross section, a lower triangular portion and an upper box portion that are aligned at an outside edge of the panel so as to form an inward wall of the stepped profile.

10. The frame strip according to claim 1, wherein the frame strip is of an extruded aluminum or aluminum alloy material.

11. The frame strip according to claim 1, wherein each frame member includes one or more securing slots, and wherein a bracket is received in the one or more securing slots and mechanically secures the frame strip to another frame strip so as to form a corner junction.

12. A frame strip assembly comprising a first frame strip and a second frame strip each according to claim 1, the first frame strip being mechanically secured to the second frame strip so as to form a corner junction.

13. The frame strip assembly according to claim 12, wherein the frame strip assembly defines a plane, and wherein the second diagonal arm extends at an angle between 30 and 60 degrees relative to the plane.

14. A frame strip for a ceiling or wall panel, the frame strip being linearly-extending and having an outside face and an interior face opposing the outside face, and a top end and a bottom end opposing the top end, the frame strip having a cross-sectional profile comprising:

a securing edge disposed at the outside face at the top end, an outwardly-stepped edge disposed at the outside face and stepped outwards of the securing edge at the bottom end, the outwardly stepped edge being less than one inch in width and of a triangular shape, an inwardly-projecting stiffening member shaped to oppose inward bowing of the frame member caused by tension across the perimeter frame, the inwardly-projecting stiffening member being disposed at the interior face and joining the outwardly stepped edge and the securing edge, wherein the triangular shape forms a lower edge portion of the stiffening member.

15. The frame strip according to claim 14, wherein a lower edge of the triangular shape includes a membrane wrap edge with a membrane securing cavity that is above the wrap edge and is located inward relative to an outside edge of the panel.

16. The frame strip according to claim 14, wherein the triangular shape merges with a mid-portion of the stiffening member, wherein the mid-portion of the stiffening member includes, in cross section, a lower triangular portion and an upper box portion that are aligned at an outside edge of the panel so as to form an inward wall of the stepped profile.

17. The frame strip according to claim 16, wherein the upper box portion of each frame member includes one or more securing slots.

18. The frame strip according to claim 17, wherein a bracket is received in the one or more securing slots and mechanically secures the frame strip to another frame strip so as to form a corner junction.

19. The frame strip according to claim 16, wherein the each frame member includes a top triangular hollow portion above the upper box portion, the top triangular hollow portion including an outside wall having a membrane securing slot securing the second membrane across the perimeter frame.

20. The ceiling wall or panel according to claim 14, wherein the frame strip is of an extruded aluminum or aluminum alloy material.

* * * * *